United States Patent [19]

Dragoy et al.

[11] 4,255,646

[45] Mar. 10, 1981

[54] ELECTRIC LIQUEFIED PETROLEUM GAS VAPORIZER

[75] Inventors: Jens T. Dragoy; Bruce D. Densmore, both of Seattle, Wash.

[73] Assignee: Sam Dick Industries, Inc., Seattle, Wash.

[21] Appl. No.: 882,974

[22] Filed: Mar. 3, 1978

[51] Int. Cl.[3] ..... F17C 7/02; F22B 1/28; F23D 11/44; C10G 9/24

[52] U.S. Cl. ..... 219/275; 48/103; 62/52; 137/341; 219/272; 219/302; 219/308; 219/328; 222/3; 239/136; 431/208

[58] Field of Search ..... 219/271-276, 219/296-299, 302-308, 314, 328, 280; 48/103; 123/122 R, 122 E, 122 F; 43/129, 130; 62/50, 52; 137/341; 122/4, 5, 40, 41, 208; 239/133-137; 222/146 R, 146 H, 146 HE, 3; 431/11, 36, 41, 207, 208; 128/192, 186, 193

[56] References Cited

U.S. PATENT DOCUMENTS

| | | | |
|---|---|---|---|
| 1,594,564 | 8/1926 | Rosier | 219/275 X |
| 2,010,331 | 8/1935 | Starrick | 219/275 X |
| 2,228,315 | 1/1941 | Hutton | 219/275 X |
| 2,266,046 | 12/1941 | Kanter et al. | 219/275 X |
| 2,272,341 | 2/1942 | Holzapfel | 219/275 X |
| 2,592,568 | 4/1952 | Hill | 219/328 X |
| 2,907,176 | 10/1959 | Tsumoda et al. | 62/52 X |
| 3,012,129 | 12/1961 | Wehl | 219/302 X |
| 3,175,075 | 3/1965 | Nord et al. | 219/302 X |
| 3,477,644 | 11/1969 | Bablouzian et al. | 431/208 X |
| 4,101,611 | 7/1978 | Williams | 128/193 X |

FOREIGN PATENT DOCUMENTS

| | | | |
|---|---|---|---|
| 916826 | 1/1963 | United Kingdom | 219/302 |

*Primary Examiner*—A. Bartis

*Attorney, Agent, or Firm*—Seed, Berry, Vernon & Baynham

[57] ABSTRACT

A compact, economical electrically heated vaporizer having a fast response time and capable of vaporizing liquified petroleum gas at a rate of ten to forty gallons or more per hour with safety and without excessive superheating and/or cracking of the liquified petroleum gas utilizes a metal casting having a closed internal cavity separated into two chambers by an integral barrier. The casting serves as a pressure vessel and heat sink as well as providing a heated interface between electric resistance heaters received in passageways in the barrier and the liquified petroleum gas. The heat generated by the heaters is disseminated uniformly throughout the casting surrounding the chambers. The liquified petroleum gas inlet at one end of the casing connects with the end of one chamber. Multiple small passageways in the barrier at the other end of the casting connect the other end of the one chamber to the adjacent end of the other chamber. The passageways are configured to create a turbulent flow which improves heat transfer. An outlet connects with the other end of the other chamber for discharge of the vaporized gas. The electrical and temperature controls for controlling the operation of the heaters and the flow of liquified petroleum gas through the chambers are housed within an enclosed chamber formed by an end cover on the other end of the casting. The temperature sensors for the temperature controls are received in passageways in the barrier.

14 Claims, 5 Drawing Figures

ELECTRIC LIQUEFIED PETROLEUM GAS VAPORIZER

BACKGROUND OF THE INVENTION

1. Field of the Invention

This invention relates to an apparatus for uniformly and economically vaporizing liquefied petroleum gas.

2. Description of the Prior Art

Electric vaporizers for vaporizing liquefied petroleum gas are known. Such units employ electric resistance heaters which are directly immersed in storage tanks for the liquefied petroleum gas or which are immersed in a liquid bath to heat the liquid bath which in turn, heats the liquefied petroleum gas to vaporize the same. U.S. Pat. Nos. 2,166,922; 2,193,066 and 2,775,683; all disclose the use of electric resistance heaters for vaporizing liquefied petroleum gas, the resistance heaters enclosed directly in the storage tank holding the liquefied petroleum gas. U.S. Pat. No. 2,348,546 discloses an electric vaporizer in an installation adjacent the liquefied petroleum gas tank through which the liquefied petroleum gas is fed. Direct heating of liquefied petroleum gas described by the above references creates a safety hazard. Additionally, the high temperature of a heating element directly in contact with the liquefied gas causes excessive cracking of the liquefied petroleum gas.

Indirect heating of liquefied petroleum gas by water baths, oil baths or other such means performs well when high vaporization capacity is needed; however, for low or medium vaporization capacities such units are both uneconomical and inefficient.

SUMMARY OF THE INVENTION

The primary object of this invention is to provide an electric liquefied petroleum gas vaporizer unit which is compact, economical and safe.

Another object of this invention is to provide an electric liquefied petroleum gas vaporizer utilizing a highly heat-conductive metal casting heated by electric resistance heaters, the casting functioning as a pressure vessel and heat interface between the heat source and the liquefied petroleum gas, as well as a heat sink to uniformly vaporize liquefied petroleum gas.

A further object of this invention is to provide an electric liquefied petroleum gas vaporizer capable of uniformly vaporizing the liquefied petroleum gas without excessive superheating and/or cracking of the liquefied petroleum gas and which gives superior response time.

A further object of this invention is to provide an electric liquefied petroleum gas vaporizer which is capable of vaporizing liquefied petroleum gas to the full capacity of the unit within minutes after it is started.

These and other objects are accomplished by a compact, economical vaporizer employing a heat-conductive casting having a closed internal cavity bridged by an integral divider dividing the cavity into two separate chambers. The chambers are interconnected at the end opposite the point of entry of the liquefied petroleum gas by multiple passageways of considerably reduced dimension relative to the dimensions of each of the chambers. The passageways increase the efficiency of the unit by creating turbulence which promotes heat exchange for more efficient vaporization. An inlet opening in the casting for liquefied petroleum gas communicates with one of the chambers and an outlet opening in the casting adjacent the inlet opening communicates with the other chamber. Bore openings in the integral divider are provided for installing electric resistance heater units which allow close control of the system. The heat generated by these units is uniformly disseminated by conduction over the surface area of the casting surrounding each of the chambers. Temperature sensing means are included in the casting for maximum control of the power delivered to the electric resistance heaters to maintain the temperature of the casting uniform.

DETAILED DESCRIPTION OF THE PREFERRED EMBODIMENTS

Figure 1:
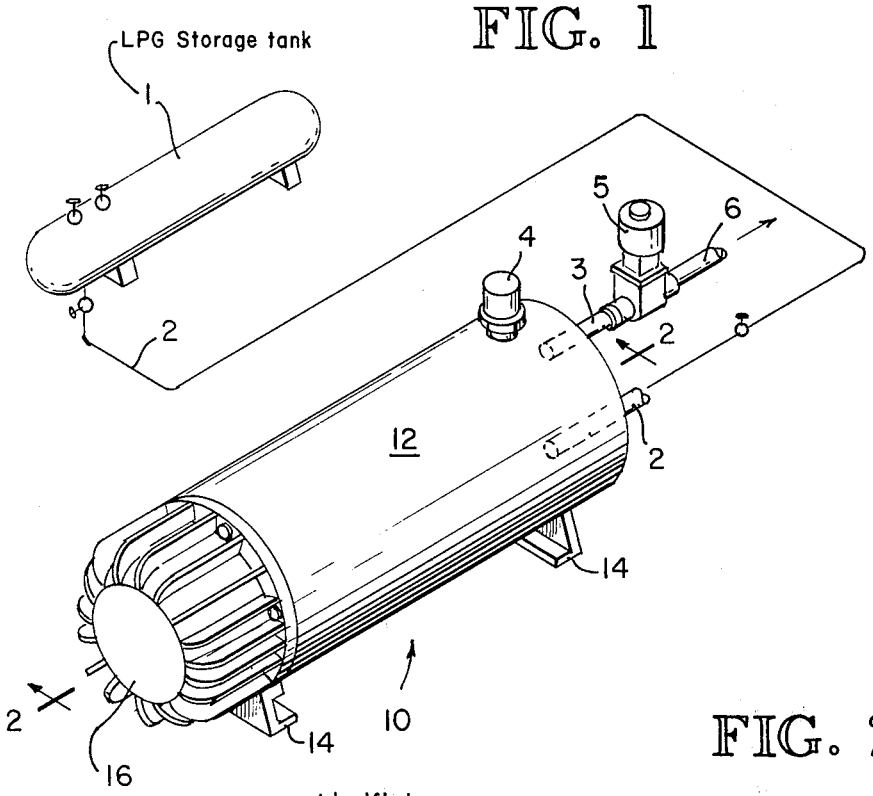
FIG. 1 is a perspective view of the vaporizer unit in relation to a storage tank for liquefied petroleum gas.

Referring to FIG. 1, the vaporizer unit 10 is shown in relation to a storage tank for liquefied petroleum gas 1. An inlet liquid gas line 2 of sufficient size to supply the vaporizer unit at full flow capacity and accommodate rapid flow changes in or out of the unit with minimum pressure drop extends from the storage tank to the vaporizer unit. Generally the liquefied petroleum gas may be pumped from the storage tank to the unit by a pump (not shown).

The vaporizer unit 10 may be an integral metal casting 12 which is of a highly heat conductive material such as aluminum. The casting may be jacketed with one or more layers of a heat insulating material if desired. The casting is supported on legs 14 which are secured to a concrete pad or other suitable support. Liquefied gas enters the vaporizer unit through line 2 and is heated during its passage through the casting and exits the unit as a gas vapor through outlet line 3 which is directly above the inlet line 2. If desired, the inlet and outlet to the casting can be reversed. The casting may be mounted horizontally or vertically. A pressure relief valve 4 is threaded through the casting 12 to communicate with the interior of the vaporizer unit for safety purposes.

An outlet solenoid valve 5 connects to gas vapor outlet line 6 as illustrated. This outlet valve acts as a safety device and prevents vapor flow from the outlet line beyond the valve until the unit is properly operating. The valve closes if the unit functions improperly. The electrical wiring for the solenoid is operatively connected to the controls 56 for the unit through a conduit (not shown). Other types of control valves may be used if desired.

Figure 2:
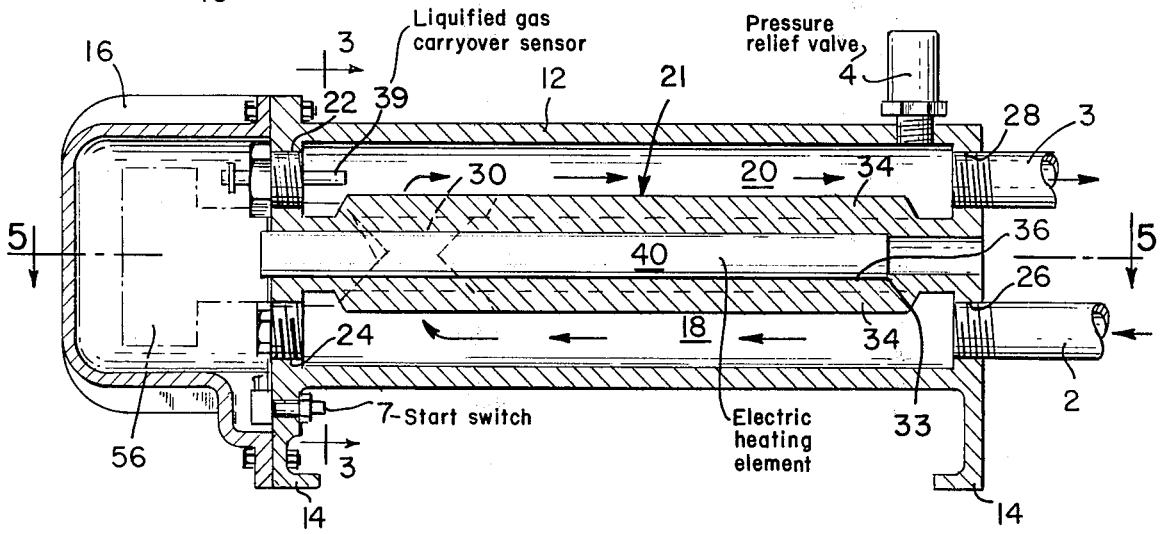
FIG. 2 is a vertical cross section through the vaporizer of FIG. 1 along section line 2—2 of FIG. 1.
Figure 3:
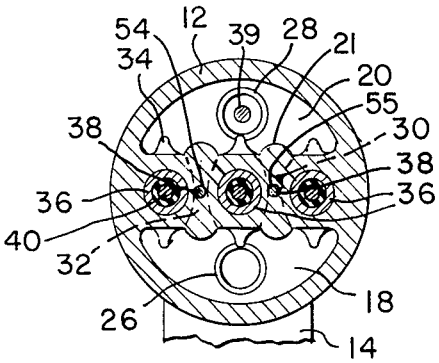
FIG. 3 is a cross section of the vaporizer unit along section line 3—3 of FIG. 2.

All of the electrical components for control of the unit as well as the wiring therefore are shown in phantom in FIG. 2 by reference number 56 and are housed within end cover 16 located at the opposite end of the casting from the liquid gas inlet and gas vapor outlets 2 and 3. In this way all of the wiring is enclosed and is totally out of contact with any liquid gas or gas vapor.

The start and stop push buttons 7 and 8 for the unit are located within the support leg 14 adjacent the end of the casting where the electrical controls are located. By locating all of the wiring and electrical controls internally in the unit the end cover 16 can be readily removed for servicing of the unit without having to cut or remove any wiring.

FIG. 2 illustrates a vertical cross section of casting 12. The casting is cylindrical and may be symmetrical about its vertical and horizontal axes. The shape of the casting is not critical, however, and may be of any desired configuration. The casting has an internal cavity separated into two chambers 18 and 20 by an integral divider 21. As illustrated the chambers 18 and 20 are of equal size although this is not critical. The openings 22 and 24 at the end of the casting adjacent the end cover 16 are plugged by suitable plugs so that no gas flow can escape the casting. Liquid gas inlet pipe 2 is threaded into the lower opening 26 and gas vapor outlet pipe 3 is threaded into the upper vapor outlet 28 of the casting as illustrated in FIG. 2. The two chambers 18 and 20 within the casting are interconnected by passageways 30 and 32 which are of considerably reduced size relative to the size of the chambers 18 and 20. The passageways 30 and 32 are configured to create a turbulent flow of the gas or gas-liquid mixture in the casting to aid in heat transfer from the walls of the casting to the liquefied gas. As illustrated in FIG. 2 each of the passageways is wedge-shaped.

The integral divider 21 separating the internal cavity of the casting into the two chambers 18 and 20 includes integral multiple fins 34 extending from the divider respectively into the chambers 18 and 20. The fins 34 increase the amount of the internal surface area of the casting exposed to the liquefied gas being introduced into the internal cavity of the casting to aid in heat transfer. The integral divider 21 also includes multiple bore openings 36 extending the length of the casting laterally of and between the passageways 30 and 32 interconnecting the chambers 18 and 20. These bore openings are designed to receive electric resistance heaters as will be described. One or more additional bore openings 38 are provided in the integral divider of the casting between the adjacent pairs of passageways 36. These bore openings 38 are designed to receive temperature sensing means 54 and 55, the temperature sensing means connected to control means for controlling power to the electric resistance heaters. A liquid gas carryover sensor 39 extends into the upper chamber 20 through the plug in opening 22 to sense, by measurement of temperature, liquefied gas carryover from the unit.

One or more electric resistance heater units 40 enclosed in a sheath of the same diameter as the diameter of bore openings 36 is inserted in the bore openings as illustrated in FIG. 2. A close fit of the electric resistance heater in the casting is desired to insure maximum heat transfer between the resistance heater and the casting. The close fit also plugs each of the bore openings 36 to maintain the explosion-proof condition of the electrical system of the unit. A ledge 33 at the end of each bore opening 36 keeps the resistance heater from being projected from the casting, should an explosion occur.

The vaporizing unit is capable of readily meeting the demand for vaporization capacities ranging from 10 to 40 or more gallons per hour. The same casting can be used for vaporization of 10 gallons per hour as for 40 gallons per hour. The only difference in the units is in the number and size of electrical resistance heaters utilized. For example, a unit capable of vaporizing 10 gallons per hour utilizes one 2.5 kw element. A unit vaporizing 20 gallons per hour utilizes two 2.5 kw elements and a unit vaporizing 30 gallons per hour utilizes three 2.5 kw elements. A 40 gallon per hour unit would employ three 3.25 kw elements, etc.

Figure 4:
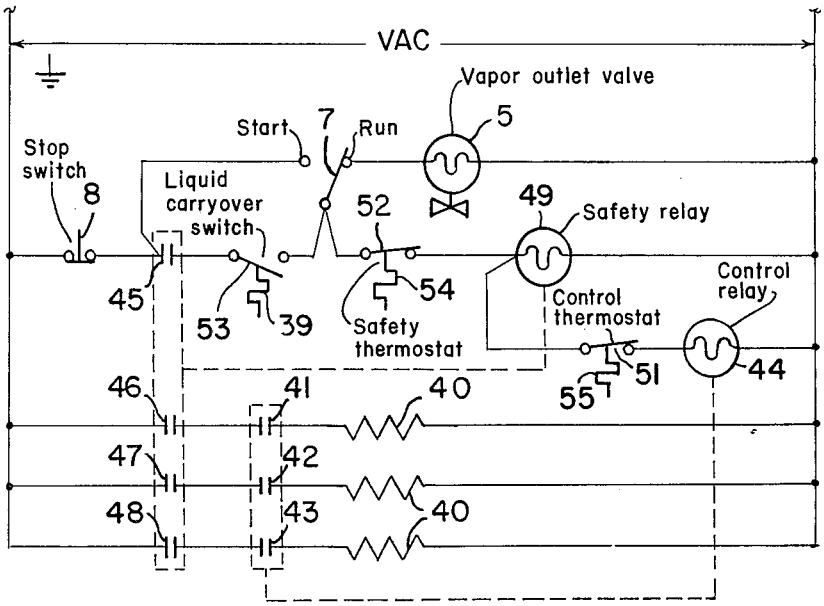
FIG. 4 is a wiring diagram of the vaporizer unit employing three resistance heaters.
Figure 5:
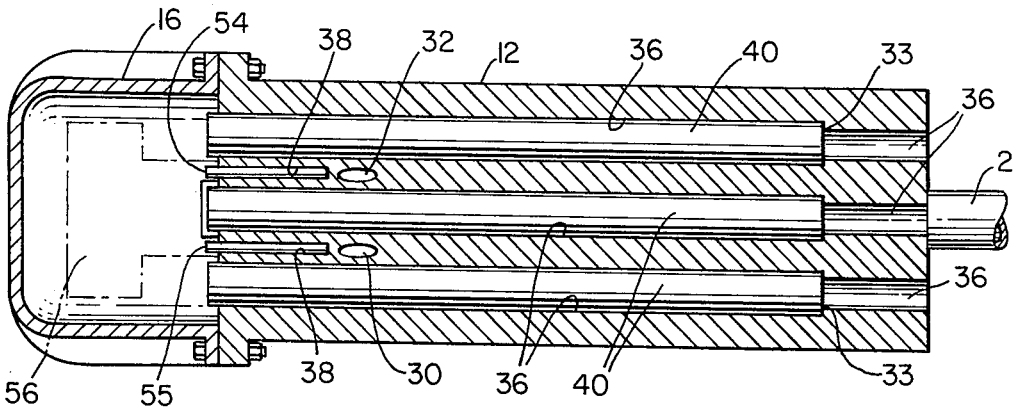
FIG. 5 is a horizontal section of the vaporizer taken along section line 5—5 of FIG. 2.

Each of the electrical resistance heaters 40 is connected to a source of electrical power through control and safety relays which are interconnected with the temperature sensing means to insure proper operation of the unit. FIG. 4 illustrates a wiring diagram for the vaporizer unit. Resistance heaters 40 are connected through contacts 41, 42 and 43 of control relay 44 and contacts 45, 46, 47 and 48 of safety relay 49 to a source of suitable voltage such as a source of single phase 240 V, 50/60 Hz power or three phase power. The unit is started by allowing liquefied gas to flow into the lower chamber 18 of the unit and activating switch 7 to the starting position until the unit has warmed to operating temperature (about 110° F.). When the switch 7 is released solenoid outlet valve 5 is actuated to allow vapor flow through line 6. Temperature sensing means 55 connected to operating temperature switch 51 retains the switch 51 in closed position until the maximum operating temperature (about 210° F.) is reached. When the switch 51 opens it deactivates control relay 44 to open contacts 41, 42 and 43 to disrupt current flow to the resistance heaters 40. A high temperature sensing means 54 of safety switch 52 is positioned in the casting and set at a predetermined temperature (such as about 300° F.). The sensing means 54 and 55 are located in bore openings 38 in divider 21. If the temperature of the casting exceeds the predetermined temperature safety switch 52 opens, interrupting current to safety relay 49, resulting in opening of contacts 45, 46, 47 and 48 to interrupt power to the heaters 40. When any of the safety limits are reached, solenoid valve 5 closes. Manual restart of the unit is required. A liquefied gas carryover switch 53 connected to sensor 39 in the casting remains closed until it senses the presence of liquid. The safety switch 53 is manually bypassed during startup.

The vaporizer is started by allowing liquefied petroleum gas to flow into the lower chamber 18 of the vaporizer unit through the inlet line 2. The vaporizer unit is warmed up to minimum operating temperature by pressing the "start" switch 7 as previously mentioned and holding it for two to three minutes. When the start button is released the outlet solenoid valve 5 opens to allow gas vapor to exit the vaporizer unit through gas vapor line 6. The flow of gas vapor at full capacity of the unit is generally available five minutes after the start switch is initially depressed. Should, for some reason, the temperature of the unit exceed the preset temperature of the high temperature switch 52, which is generally about 300° F., the power will be disconnected from the electric resistance heaters. The liquid carryover switch 53, previously described, provides an extra safety measure. Should liquefied gas be sensed the switch 53 opens, solenoid valve 5 closes, power to the electric resistance heaters is disrupted and manual restart is required.

The liquefied petroleum gas enters the lower chamber as a liquid and is heated to its vaporization point. The passageways 30 and 32 between the upper and lower chambers are small enough to create turbulence and disperse the liquefied gas into small droplets which rapidly flash to gas vapor as the liquefied gas flows through the passageways. The upper chamber further heats the vaporized gas to a proper superheated condition. The unit is stopped by pressing switch 8 to deactivate relays 49 and 44, outlet valve 5 and heaters 40.

The unit as described is a compact versatile unit for vaporizing liquefied petroleum gas employing a heat sink in the form of a highly heat conductive metal casting also serving as a pressure vessel and heat interface between a source of heat and the liquefied petroleum gas. Flow surges can be readily accommodated. Excessive superheating of the liquefied petroleum gas is prevented by the relatively low temperature of the heat sink in contrast to direct contact of the liquefied petroleum gas with a heat source which causes cracking of the gas, resulting in polymerization, tarry residues and undesired components to form. The unit can go from no load to full load almost instantaneously—a matter of seconds and can thus quickly respond to load changes.

I claim:

1. A compact economical electric vaporizer unit for vaporizing liquefied gas comprising:

an elongated heat-conductive casting having a longitudinally extending internal cavity bridged by an integral longitudinal divider dividing the cavity into separate elongated chambers, the casing serving both as a pressure vessel for the liquefied gas and a heat interface between a source of heat and the liquefied gas, multiple passageways through one end of the divider interconnecting the separate chambers, the passageways being sufficiently small relative to the dimension of each of the chambers and configured to create turbulence and disperse the liquefied gas into small droplets which rapidly flash to gas vapor, a liquefied gas inlet opening in the casting at a location remotely spaced from the multiple passageways and communicating with one of the chambers, a gas vapor outlet opening in the casing adjacent the inlet opening and remotely spaced from the multiple passageways and communicating with the other chamber, at least one passageway in the integral divider, each passageway holding an electric resistance heat unit, at least one temperature sensing port in the divider, each port receiving a temperature sensing means, electric power supply means connected to said at least one electric resistance heater unit, and control means responsive to the at least one temperature sensing means and operatively connected to the electric power supply means for regulating the supply of electric power to the at least one heat unit.

2. The vaporizer of claim 1 wherein the interior surface of each of the chambers includes fins to increase the overall surface area to which the liquefied gas entering the chambers is exposed.

3. The vaporizer of claim 2 wherein the casting is symmetrical about its vertical and horizontal axes.

4. The vaporizer of claim 1 wherein the ends of each of the heater units are exposed at one end of the casting, the control means is mounted on the end of the casting immediately adjacent to the exposed heater unit ends, and an end cover is provided on the end of the casting for completely enclosing the exposed ends of the electric resistance heater units and control means therefor.

5. The vaporizer of claim 4 wherein the casting is an aluminum casting.

6. The vaporizer of claim 1 wherein contact of each of the electric resistance heater units with the casting is such as to insure maximum heat transfer between the electric resistance heater units and the casting.

7. The vaporizer of claim 1, wherein there are two passageways in the divider, each holding a resistance heater unit and two temperature sensing ports are provided with a temperature sensing means in each port, the ports being located between the electric resistance heater units.

8. The vaporizer of claim 1 wherein the chambers are of equal volume.

9. The vaporizer of claim 1 wherein the chambers and the multiple passageways define a labrinyth passageway leading from the inlet opening to the outlet opening for vaporizing liquefied gas introduced into the inlet opening.

10. The vaporizer of claim 1 wherein the casting is horizontally oriented relative to the elongated dimension thereof, and wherein the divider divides the cavity into an upper and lower chamber, wherein there are three passageways in the integral divider, each holding an electric resistance heater unit, the passageways located in a single horizontal plane in the integral divider between the upper and lower chambers.

11. The vaporizer of claim 10 wherein the control means includes a liquefied gas sensing means in the upper chamber adjacent the multiple passageways, a shutoff valve adjacent the gas vapor outlet opening operatively connected to the liquefied gas sensing means for shutting off the flow of gas vapor from the vaporizer in response to liquefied gas being sensed by the liquefied gas sensing means.

12. The vaporizer claim 11 concluding a pressure relief valve communicating with the upper chamber in the casting responsive to the pressure of the gas vapor therein.

13. A compact economical vaporizer having a vaporization capacity of ten to forty gallons or more of liquefied gas per hour or more, comprising:

an elongated heat-conductive casting having an enclosed longitudinally extending central cavity bridged by an integral divider dividing the central longitudinally extending cavity into at least two elongated separate vaporization chambers, multiple passageways through one end of the divider interconnecting the two chambers, the passageways being sufficiently small relative to the dimension of each of the vaporization chambers and configured to create turbulence and disperse the liquefied gas into small droplets which rapidly flash to gas vapor, a liquefied gas inlet opening in the casting at the remote end of the casting remote from the multiple passageways and communicating with one of the chambers, a gas vapor opening in the casting at the end of the casting remote from the multiple passageways, adjacent the inlet opening and communicating with another of the chambers, passageways in the integral divider, each holding an electric resistance heater unit, temperature sensing passageways in the divider adjacent the electric resistance heater units, each receiving temperature sensing means, electric power supply means connected to the electric resistance heater units at the end of the casting opposite the inlet and outlet openings, control means at the end of the casting opposite the inlet and outlet openings responsive to the sensing means and operatively connected to the electric power supply means for regulating the supply of the power to the heater units, and an end cover on the end of the casting covering and sealing the control means.

14. A compact economical electric vaporizer for vaporizing liquid petroleum gas comprising:

an elongated heat-conductive casting having an enclosed longitudinally extending central cavity bridged by an integral divider dividing the longitudinally extending cavity into upper and lower chambers of substantially equal volume, the casting horizontally oriented with respect to the upper and lower chambers thereof, multiple passageways through one end of the divider interconnecting the upper and lower chambers, the passageways being sufficiently small relative to the dimension of the upper and lower chamber and configured to create turbulence in the liquefied gas flow therethrough to disperse the liquefied gas into small droplets which rapidly flash to gas vapor;

a liquefied petroleum gas inlet opening in the casting at a location remotely spaced from the multiple passageways communicating with the lower chamber, a gas vapor outlet opening in the casting immediately adjacent the inlet opening communicating with the upper chamber and remotely spaced from the multiple passageways, three passageways in the integral divider between the upper and lower chambers, all in a single horizontal plane, each passageway holding an electrical resistance heater unit, the temperature sensing ports located in the divider between the electrical resistance heater units, each sensing port receiving a temperature sensing means, electric power supply means connected to the electric resistance heater units, a liquefied gas sensing means in the upper chamber adjacent the multiple passageways, a gas vapor shut-off valve adjacent the gas vapor outlet opening operatively connected to the liquefied gas sensing means for shutting off the flow of gas vapor from the gas vapor outlet of the vaporizer unit in response to liquefied gas being sensed by the liquefied gas sensing means, and control means responsive to the temperature sensing means and operatively connected to the electric power supply means for regulating the supply of electric power to the heater units.

* * * * *